US009758346B2

(12) United States Patent
Aulanko et al.

(10) Patent No.: US 9,758,346 B2
(45) Date of Patent: Sep. 12, 2017

(54) TENSIONING ARRANGEMENT FOR A TRACTION MEANS OF AN ELEVATOR

(71) Applicant: KONE Corporation, Helsinki (FI)

(72) Inventors: Esko Aulanko, Kerava (FI); Matti Räsänen, Hyvinkää (FI); Janne Mikkonen, Järvenpää (FI); Pentti Alasentie, Espoo (FI)

(73) Assignee: KONE CORPORATION, Helsinki (FI)

( * ) Notice: Subject to any disclaimer, the term of this patent is extended or adjusted under 35 U.S.C. 154(b) by 410 days.

(21) Appl. No.: 14/092,696

(22) Filed: Nov. 27, 2013

(65) Prior Publication Data

US 2014/0083802 A1 Mar. 27, 2014

Related U.S. Application Data

(63) Continuation of application No. PCT/FI2012/050644, filed on Jun. 20, 2012.

(30) Foreign Application Priority Data

Jun. 22, 2011 (FI) ..... 20115641

(51) Int. Cl.
*B66B 7/10* (2006.01)
*B66B 11/00* (2006.01)
*B66B 19/00* (2006.01)

(52) U.S. Cl.
CPC ..... *B66B 7/10* (2013.01); *B66B 11/009* (2013.01); *B66B 19/007* (2013.01)

(58) Field of Classification Search
CPC ..... B66B 5/12; B66B 7/10; B66B 11/009
See application file for complete search history.

(56) References Cited

U.S. PATENT DOCUMENTS 657,380 A * 9/1900 Baldwin et al. ..... B66B 11/009 187/265
1,132,769 A 3/1915 Gale
(Continued)

FOREIGN PATENT DOCUMENTS

CN 103562112 A 2/2014
EP 1 493 708 A2 1/2005
(Continued)

*Primary Examiner* — Minh Truong
(74) *Attorney, Agent, or Firm* — Birch, Stewart, Kolasch & Birch, LLP

(57) ABSTRACT

The object of the invention is a tensioning arrangement for a traction means of an elevator, which arrangement comprises at least an elevator car configured to move up and down in an elevator hoistway and at least one or more compensating weights, which are for their part connected to support the elevator car by the aid of their own support means, such as by the aid of ropes or belts and also of diverting pulleys, and a hoisting machine provided with at least one traction sheave or corresponding, and also at least one traction means (7) such as a belt, rope or chain, which is configured to transmit the rotational movement of the traction sheave into movement of the elevator car and of the compensating weights. The traction means (7) is fixed from at least one of its ends to a fixing means (1) providing an essentially constant tensioning force.

9 Claims, 5 Drawing Sheets

(56) References Cited

U.S. PATENT DOCUMENTS 1,901,635 A * 3/1933 Dunlop ..... B66B 5/12 187/411
3,174,585 A * 3/1965 Tofanelli ..... B66B 11/009 187/264
4,760,622 A * 8/1988 Rohrman ..... E05D 13/1207 16/196
4,914,780 A * 4/1990 Rogers ..... E05D 13/123 16/16
5,101,735 A * 4/1992 Williams ..... E01B 25/18 104/117
5,311,827 A * 5/1994 Greene ..... A47B 9/02 108/147
5,437,347 A 8/1995 Biewald et al.
5,566,783 A * 10/1996 Yamashita ..... B66B 11/08 187/210
6,425,463 B1 * 7/2002 Broyan ..... B66B 7/062 187/254
6,434,851 B1 * 8/2002 Nishina ..... F02K 1/763 33/559
7,717,237 B2 * 5/2010 Zamorano Morfin .... B66B 9/02 187/264
7,798,290 B2 * 9/2010 Mustalahti ..... B66B 7/10 187/264
8,210,320 B2 * 7/2012 Ach ..... B66B 7/062 187/251
2006/0102434 A1 * 5/2006 Nomura ..... B66B 11/009 187/266
2011/0094831 A1 * 4/2011 Jezek ..... B66B 7/10 187/264
2014/0034425 A1 2/2014 Rasanen et al.

FOREIGN PATENT DOCUMENTS

EP 1 097 101 B1 5/2007
EP 1 783 088 A1 5/2007
EP 1992582 A1 11/2008
FR 2586407 A1 2/1987
FR 2 813 874 A1 3/2002
FR 2 823 734 A1 10/2002
JP 2007-269417 A 10/2007
WO WO 03/043927 A2 5/2003
WO WO 03/086937 A1 10/2003
WO WO 2004/041701 A1 5/2004
WO WO 2012/156583 A1 11/2012

* cited by examiner

TENSIONING ARRANGEMENT FOR A TRACTION MEANS OF AN ELEVATOR

CROSS REFERENCE TO RELATED APPLICATIONS

This non-provisional application is a Continuation of International Application No. PCT/FI2012/050644 filed on Jun. 20, 2012, which claims the benefit of Finland Application No. 20115641 filed in Finland on Jun. 22, 2011. The entire contents of all of the above applications are hereby incorporated by reference.

The object of the invention is a tensioning arrangement for a traction means of an elevator.

The arrangement according to the invention is, owing to its solution of having a traction means separate from the suspension ropes of the elevator car, well suited to elevators intended for low-rise and medium-rise buildings and even to extremely high-rise buildings, in which one problem is that when the hoisting machine of the elevator is above, installation of the machine and peripheral structures is awkward, expensive and even dangerous. Additionally, the high-speed elevators in high-rise buildings require large fuses and there are often many elevators in one or more elevator groups. For this reason also the electric cabling needed for the elevator hoisting machines are expensive and in high-rise buildings this is even more pronounced because the electric cables from the power distribution boards below to the hoisting machines above are long. Long electric cables cause power losses and various other interferences in their immediate environment, e.g. electromagnetic interferences. The arrangement according to the invention is also suited to new elevators in low-rise buildings that previously had no elevator. In addition, the solution according to the invention is well suited to the modernization of old elevators.

Figure 8:
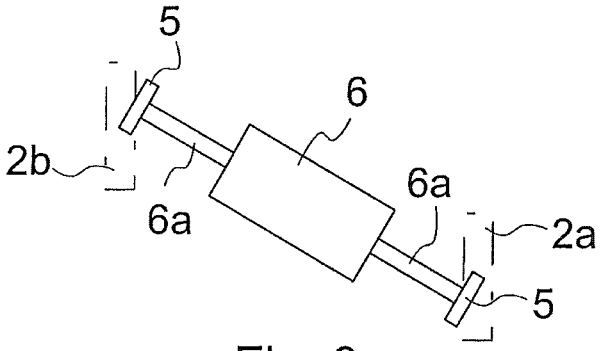
Figure 9:
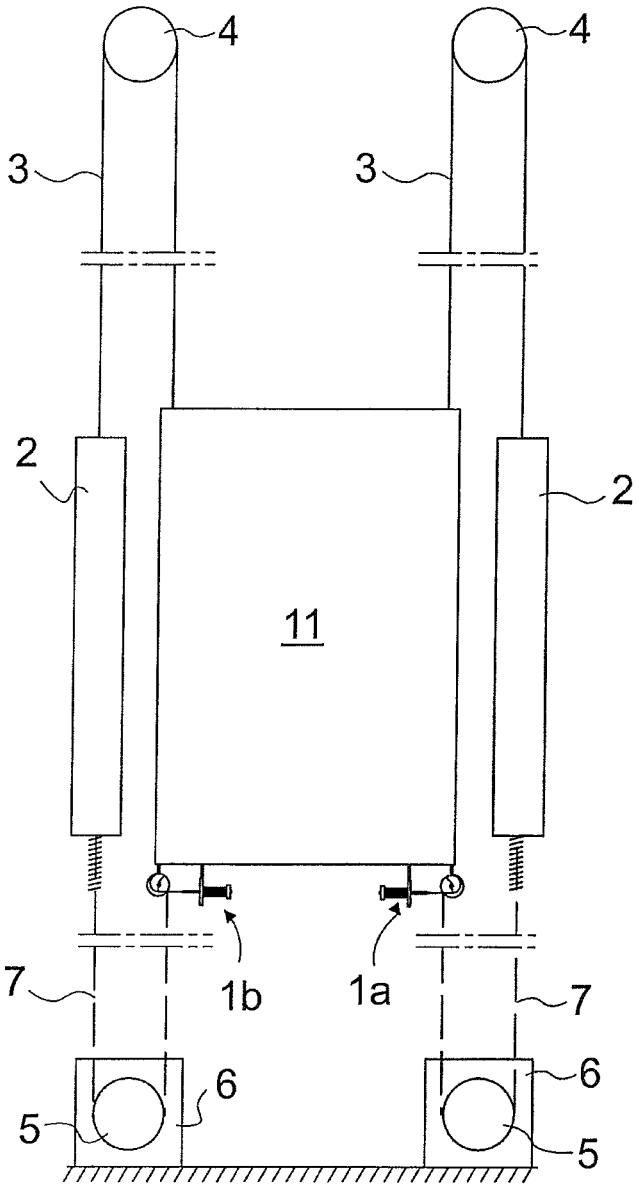

Elevator solutions wherein the hoisting machine of the elevator is disposed on the base of the elevator hoistway, or close to the bottom part of the elevator hoistway, are known in the art. When the hoisting machine is disposed thus, the suspension ropes of the elevator cannot generally function simultaneously as the means intended for moving the elevator car, but instead separate traction ropes, traction belts or other traction means are needed for moving the elevator car. One such prior-art solution is presented in international patent publication no. WO03/043927 A2, in which FIGS. 8 and 9 present solutions wherein the hoisting machine of an elevator is in the bottom part of the hoistway and the suspension ropes of the elevator car and the traction ropes are different ropes. The elevator car and the counterweight are supported by the aid of a diverting pulley above, over which the suspension ropes fixed to the elevator car and to the counterweight pass. Correspondingly, the moving of the elevator car is implemented with a separate toothed belt, which passes around the traction sheave of a hoisting machine below and is fixed from below between the elevator car and the counterweight. According to FIGS. 8 and 9, the tensioning of the toothed belt is arranged via a compression spring, but according to the publication it can also be arranged by the aid of a counterweight. A problem in these solutions is at least that both solutions are difficult to alter in relation to the layout. Additionally, in the solution used one large counterweight takes space to such an extent that flexible layouts cannot easily be used. Likewise the tensioning of a toothed belt is not a solution enabling constant tensioning force.

Patent publications EP1097101 B1, EP1493708 A2, FR2813874 A1 and FR2823734 A1 also present corresponding elevator solutions, wherein the hoisting machine of an elevator is on the base of the hoistway, or close to it, and the suspension ropes of the elevator car and the traction ropes are separate. Of these only publication EP1097101 B1 presents the tensioning of a traction means, but it is implemented with a combination of a spring and a counterweight, which combination is large in size and does not enable constant-force tensioning. In all these solutions, however, there is also only one large counterweight, the drawbacks of which solution have been explained in the preceding.

The aim of the present invention is to eliminate the aforementioned drawbacks and achieve an inexpensive and easy-to-implement arrangement, which combines the advantages of a hoisting machine disposed in the bottom part of the elevator hoistway and of flexible layout design and in which the tensioning of one or more traction means separated from the suspension ropes can be arranged as constant-force tensioning. Additionally, the aim of the invention is to achieve an arrangement, which enables a number of different, easy-to-implement suspension options for an elevator with a machine room below. Likewise, one aim is to achieve an elevator arrangement, which can be implemented with essentially the same type of elevator for different purposes, such as for residential apartment use or hotel use, and in which the operation of the elevator can be optimized in relation to energy consumption according to the amount and the nature of the elevator traffic.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can, in at least some situations, be deemed to be inventive in their own right.

One advantage, among others, of the solution according to the invention is that by means of it an easy and reliable tensioning of traction means is enabled, which replaces tensioning provided with space-consuming and expensive weights. In this case another advantage is also that the solution according to the invention is space-efficient in both the width direction and the depth direction of the elevator hoistway. Yet another advantage is that by means of the arrangement according to the invention the rope arrangements and layouts of elevators can be diversified, which enables easier layout design. Another advantage is that installation of a hoisting machine is easier and cheaper than when installing the hoisting machine into the top part of a building. Likewise the structures and peripherals of the elevator are in this case lighter and cheaper. Yet another advantage is that the same elevator concept can be used for different applications, e.g. for residential apartment use or hotel use, and the use of the elevator can be monitored after the original installation and, based on the results, the balance of the elevator can easily be changed to correspond better to the actual use of the elevator. Yet another advantage is faster and easier installation of an elevator.

An advantageous pulling means is an ordinary compression spring. Instead of such a spring, e.g. a gas spring can be used. A gas spring does not, however, have a normal spring constant, in which case its force response to compression or stretching differs from the linear. A non-linear change in spring force can, however, be compensated according to the invention.

Figure 1:
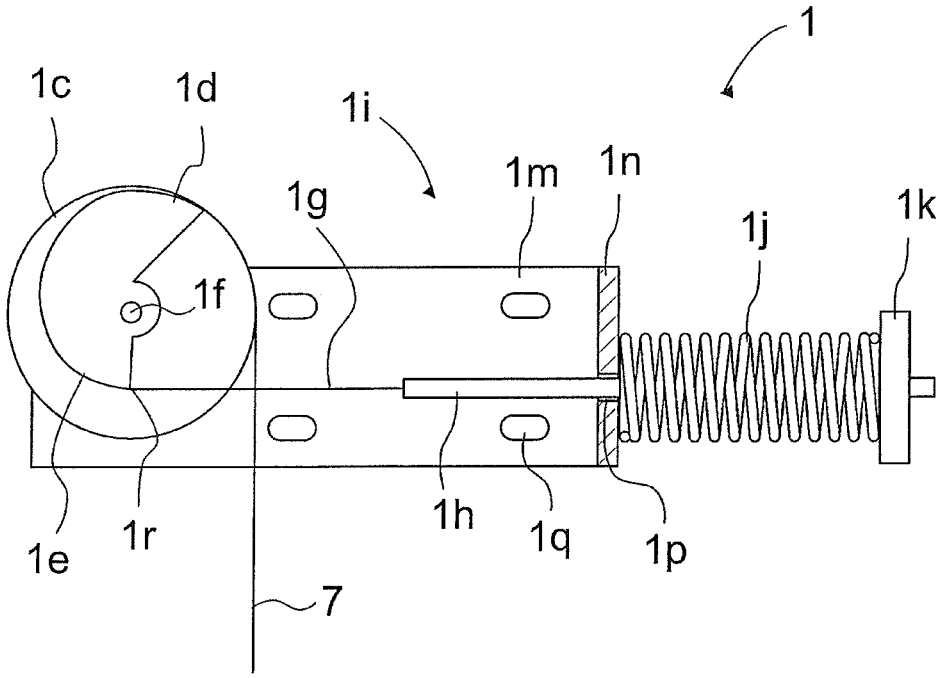
Figure 1A:
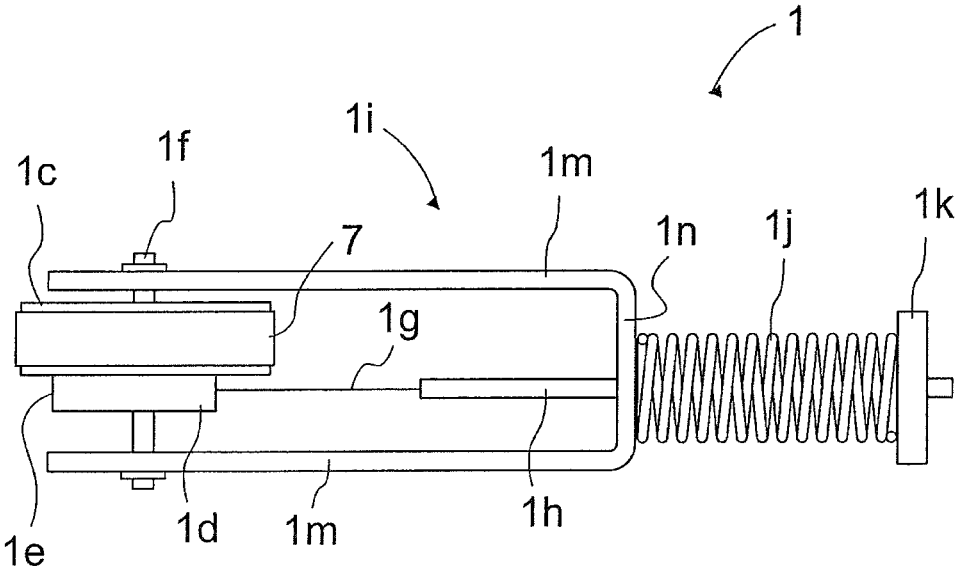
Figure 2:
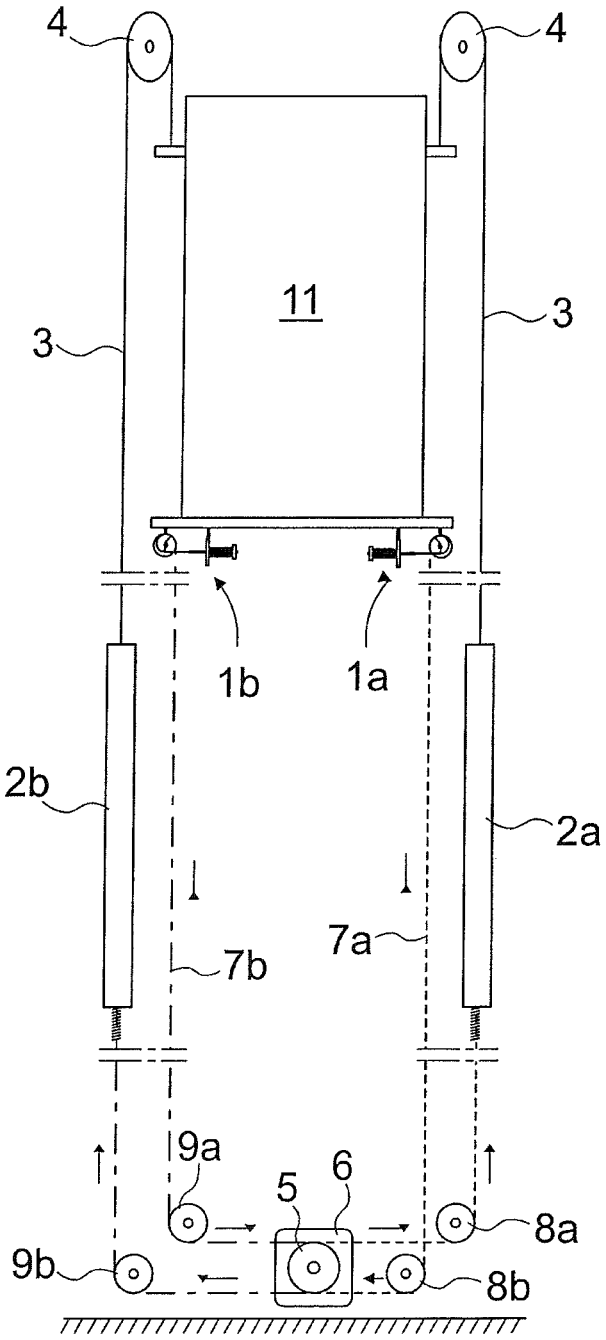
Figure 3:
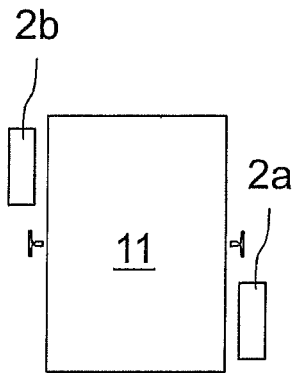
Figure 4:
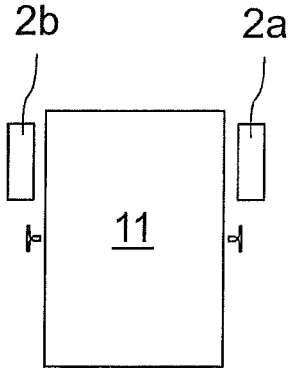
Figure 5:
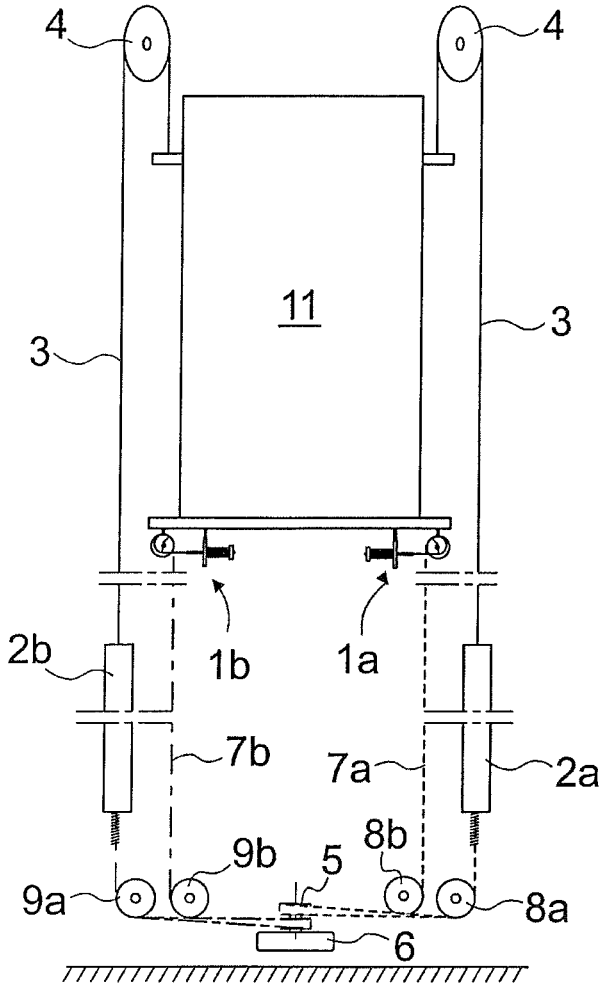
Figure 6:
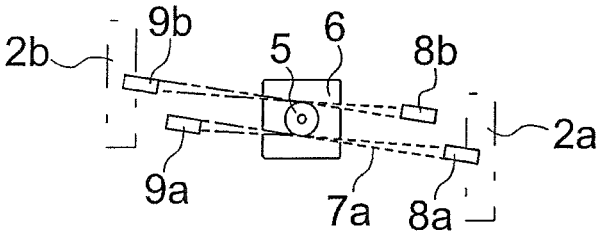
Figure 7:
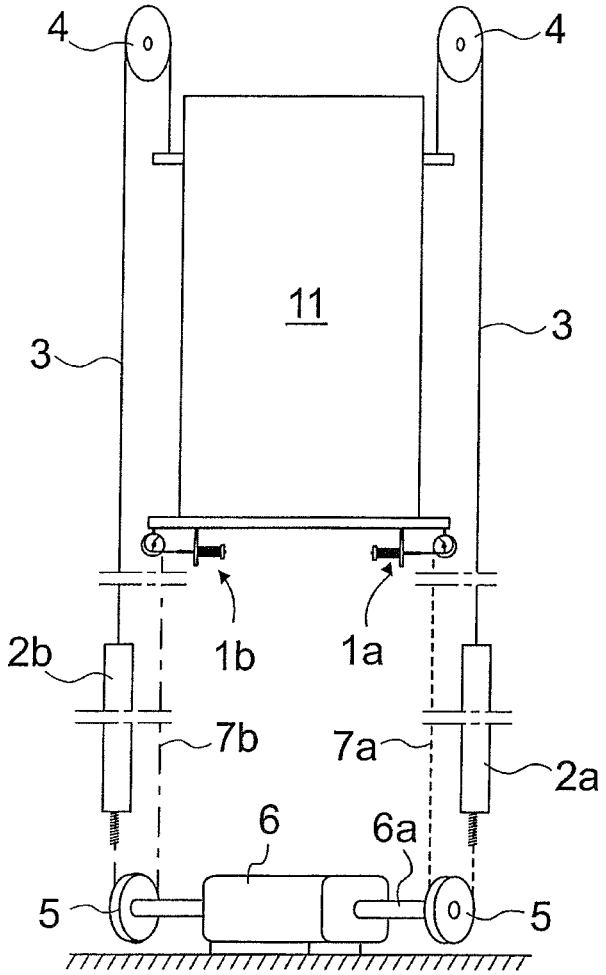

In the following, the invention will be described in more detail by the aid of some examples of its embodiment with reference to the simplified and diagrammatic drawings attached, wherein FIG. 1 presents a simplified and diagrammatic side view of one fixing arrangement of a traction means of an elevator according to the invention, FIG. 1*a* presents a simplified and diagrammatic top view of the fixing arrangement of a traction means of an elevator according to FIG. 1, FIG. 2 presents a simplified and diagrammatic side view of one elevator arrangement according to the invention, wherein the hoisting machine of the elevator is disposed in the bottom part of the elevator hoistway, or close to it, FIG. 3 presents a simplified and diagrammatic top view of one elevator arrangement according to FIG. 2, wherein the compensating weights are disposed on different sides of the guide rail line of the elevator car to each other and on different sides of the elevator car, FIG. 4 presents a simplified and diagrammatic top view of one elevator arrangement according to FIG. 2, wherein the compensating weights are disposed on the same side of the guide rail line of the elevator car as each other and on different sides of the elevator car, FIG. 5 presents a simplified and diagrammatic side view of one second elevator arrangement according to the invention, wherein the hoisting machine of the elevator is disposed in the bottom part of the elevator hoistway, or close to it, FIG. 6 presents a simplified top view of an elevator arrangement according to FIG. 5, in the bottom part of the elevator hoistway, FIG. 7 presents a simplified and diagrammatic side view of one third elevator arrangement according to the invention, wherein the hoisting machine of the elevator is disposed in the bottom part of the elevator hoistway, or close to it, FIG. 8 presents a simplified top view of an elevator arrangement according to FIG. 7, in the bottom part of the elevator hoistway, and FIG. 9 presents a simplified and diagrammatic front view of yet one more elevator arrangement according to the invention, wherein two hoisting machines of the elevator are disposed in the bottom part of the elevator hoistway, or close to it.

FIGS. 1 and 2 present one fixing arrangement of a traction means 7 of an elevator according to the invention. The tensioning arrangement comprises at least one or more fixing means 1, 1*a*, 1*b* fixed from its frame part 1*i* to the bottom part of the elevator car 11, either directly to the elevator car 11 or in connection with the car sling of the car, which fixing means is configured to enable tensioning that is of as constant a force as possible in the traction means 7, 7*a*, 7*b*.

A fixing means 1, 1*a*, 1*b* comprises at least the aforementioned frame part 1*i*, a roll 1*c* mounted on bearings onto an axle 1*f* so as to rotate freely, an adjustment means 1*d* rotating along with the roll 1*c*, and also a tensioning means 1*g*, the free end of which is tensioned by the aid of a spring 1*j* into its position in the second end of the frame part 1*i*. The frame part 1*i* is e.g. a metal plate bent into a U-shape, as viewed from above, comprising a base part 1*n* and two side flanges 1*m* that are in an orthogonal attitude in relation to it, of which side flanges at least one has fixing holes 1*q* for fixing the fixing means 1, 1*a*, 1*b* to its mounting base. Correspondingly, the base part 1*n* at the second end of the frame part 1*i* has a hole 1*p* for the rod 1*h* at the free end of the tensioning means 1*g*, through which hole 1*p* the rod 1*h* can be threaded. In addition, there is a hole in the first end, i.e. the free end, of the side flanges 1*m* for the axle 1*f* of the roll 1*c*.

On the elevator car 11 side, the end of the traction means 7, 7*a*, 7*b*, such as of a toothed belt, of the elevator is fixed to the outer rim of the roll 1*c* such that the end of the traction means 7, 7*a*, 7*b* on the elevator car 11 side can be coiled for some distance onto the roll 1*c* when the roll 1*c* rotates around its axle 1*f* as the traction means 7, 7*a*, 7*b* loosen.

An adjustment means 1*d* rotating along with the roll 1*c*, and having an essentially e.g. spiral outer surface 1*e* that is eccentric with respect to the axis of rotation 1*f*, is fixed to the side of the roll in connection with the roll 1*c*, the length of which eccentric outer surface 1*e*, e.g. in the arrangement according to the embodiment, comprises less than one revolution, i.e. the length of the spiral outer surface 1*e* is smaller than 360°. A tensioning means 1*g*, such as a steel rope or plastic rope or corresponding, is fitted for rotating the eccentric outer surface 1*e* of the adjustment means 1*d*, which tensioning means is fixed at its first end to move along with the roll 1*c* and the adjustment means 1*d*, and at its second end to a tensioning arrangement provided with a rod 1*h* through the base part 1*n* of the frame part 1*i*, with a flange 1*k* and also with a compression spring 1*j*, in which tensioning arrangement the compression spring 1*j* is arranged to press against the outer surface of the base part 1*n* of the frame part 1*i* such that the tensioning arrangement pulls the tensioning means 1*g* by the aid of the spring force of the spring 1*j* and keeps the tensioning means 1*g* always as taut as possible by the aid of its spring force.

What is essential to the solution according to the invention is that the eccentricity, i.e. the spiral pitch, of the outer rim 1*e* of the adjustment means 1*d* is selected such that it corresponds to the spring constant of the spring 1*j*, in which case in all the rotational positions of the adjustment means 1*d* the tensioning of the traction means 7, 7*a*, 7*b* remains essentially the same corresponding to the spring constant. When the traction means 7, 7*a*, 7*b* stretches or otherwise loosens, the spring 1*j* pulls the tensioning means 1*g* and via it rotates the roll 1*c* and the adjustment means 1*d* such that the distance of the outer rim 1*e* of the adjustment means 1*d* from the axle 1*f* at the point of detachment 1*r* of the tensioning means 1*g* increases according to the eccentricity of the outer rim 1*e*. The eccentricity, i.e. the spiral pitch, of the outer rim 1*e* of the adjustment means 1*d* can also be selected such that the adjustment means 1*d* can compensate in the aforementioned manner a spring other than a compression spring 1*j*, e.g. a gas spring, a draw-spring or some other means providing a spring force. In the case of a gas spring this can mean a non-linear spiral pitch.

To enable the arrangement according to the invention, at least one elevator arrangement comprises at least an elevator car 11 configured to move up and down in an elevator hoistway and at least one or more compensating weights 2*a*, 2*b*, which are for their part connected to support the elevator car 11 by the aid of their own support means 3 that are completely separate from the traction means 7, 7*a*, 7*b*, such as by the aid of belts or ropes and also by the aid of e.g. diverting pulleys 4 mounted on bearings in the top part of the elevator hoistway. In addition, the arrangement according to the invention comprises a hoisting machine 6 provided with at least one traction sheave 5 or corresponding, and at least two or more traction means 7*a*, 7*b*, such as a rope or a belt, which are configured to transmit the rotational movement of the traction sheave 5 into linear movement of the elevator car 11 and of the compensating weights 2*a*, 2*b*. Characteristic to the invention, and common to all the different embodiments of the invention, is that each compensating weight 2*a*, 2*b*, or in some cases only one, or more than two, compensating weights, are connected by the aid of their own traction means 7*a*, 7*b* provided with essentially constant tensioning to most preferably one and the same hoisting machine 6. If there is only one compensating weight, for safety reasons there are nevertheless at least two traction means 7, 7*a*, 7*b* so that when one traction means loses its grip, the other one still grips and the elevator car 11 is not able to rush to the roof with a small load pulled by the compensating weight.

The aforementioned two or more compensating weights 2*a*, 2*b* enable an essentially easy layout in elevator design. At the same time the layout also brings various space benefits. In this case one layout solution can be e.g. the type of layout in which, when viewed from above, at the center of the elevator hoistway is a plane formed by the car guide rails of the elevator and around this plane are four corners for different structural solutions. For example, two corners are used for the compensating weights 2*a*, 2*b* and their guide rails, one corner is used for safety devices, mainly e.g. for an overspeed governor, and one corner is used for other devices, such as for the trailing cables, et cetera. From the viewpoint of the layout, it is advantageous to situate the compensating weights 2*a*, 2*b*, with their guide rails, in the rear corners of the elevator hoistway.

FIG. 2 presents a simplified and diagrammatic side view of one elevator arrangement according to the invention. The elevator arrangement according to FIG. 2 comprises two compensating weights 2*a* and 2*b*, both of which are connected to the elevator car 11 by the aid of their own support means 3. Each support means 3 is fixed at its first end to the elevator car 11 and passes over a diverting pulley 4 in the top part of the elevator hoistway or in the machine room and returns downwards, and is fixed at its second end to a compensating weight functioning as a counterweight 2*a*, 2*b*. The fixing point of the first end of the support means 3 to the elevator car 11 is configured such that the elevator car 11 can rise past the diverting pulleys 4 in the top end of the hoistway right to the top end of the hoistway. In this way the most space-efficient layout solution possible is achieved. All the elevator arrangements according to the invention can comprise the same type of fixing solution of the support means 3 to the elevator car 11, although that is not presented in all the figures.

A hoisting machine 6 provided with a traction sheave 5 is configured to move the elevator car, which hoisting machine is preferably disposed in the bottom part of the elevator hoistway, e.g. on the base of the elevator hoistway or right in the proximity of the base. In this case installation of the hoisting machine 6 is easy, and long electric cables from the bottom part of the building to the hoisting machine and to the cubicles are not needed. Additionally, at least one humidity sensor, which is arranged to issue an alarm and if necessary to stop the elevator if excessive water comes onto the base of the hoistway, is disposed on the base of the hoistway. In this way the elevator machine and the electrical components of the elevator can be protected from excessive humidity.

For each compensating weight separately its own traction means 7*a*, 7*b* is disposed between the bottom part of the compensating weights 2*a*, 2*b* and the bottom part of the elevator car 11, which traction means receives its movement transmission force from the traction sheave 5 of the hoisting machine 6. The first traction means 7*a* is fixed at its first end to a first compensating weight 2*a*, is configured to leave the compensating weight 2*a* and go downwards and is led to pass under at least one diverting pulley 8*a*, after which the traction means 7*a* is led to a traction sheave 5, which rotates on the vertical plane, of a hoisting machine 6 disposed below the elevator car 11 from the first side of the traction sheave 5, and is configured to pass around the traction sheave 5 on a first point of the contact surface of the traction sheave 5 on the second side of the traction sheave 5, to return back to the first side of the traction sheave 5 and is led onwards to pass under at least a second diverting pulley 8*b* and to ascend after this to the elevator car 11, to a fixing means 1*a* maintaining essentially constant tensioning force, on which elevator car the traction means 7*a* is fixed at its second end.

The second traction means 7*b* is configured to travel from the second compensating weight 2*b* via the traction sheave 5 to the elevator car in essentially the same manner as the first traction means 7*a*. In this case the second traction means 7*b* is fixed at its first end to a second compensating weight 2*b*, is configured to leave the compensating weight 2*b* and go downwards and is led to pass under at least one diverting pulley 9*a*, after which the traction means 7*b* is led to a traction sheave 5, which rotates on the vertical plane, of the hoisting machine 6 disposed below the elevator car 11 from the second side of the traction sheave 5, and is configured to pass around the traction sheave 5 on a second point of the contact surface of the traction sheave 5 on the first side of the traction sheave 5, to return back to the second side of the traction sheave 5 and is led onwards to pass under at least a second diverting pulley 9*b* and to ascend after this to the elevator car 11, to a fixing means 1*b* maintaining essentially constant tensioning force, on which elevator car the traction means 7*b* is fixed at its second end.

The contact surface of the traction sheave 5 is so wide that both the traction means 7*a*, 7*b* fit side-by-side onto the contact surface of the traction sheave without interfering with each other. In this way one and the same hoisting machine 6 gives to both the traction means 7*a*, 7*b* a force producing linear movement of the elevator car 11 and of the compensating weights 2*a*, 2*b*.

FIGS. 3 and 4 present top views of different options for disposing the compensating weights 2*a*, 2*b* in the elevator hoistway. In FIG. 3 the compensating weights 2*a*, 2*b* are disposed on opposite sides of the elevator car 11 and on different sides of the guide rail line of the elevator car 11 to each other, in which case the suspension of the elevator car 11 and of the compensating weights 2*a*, 2*b* is very symmetrical and does not produce any additional stresses e.g. on the guide rails. This is an extremely advantageous layout option if it is only possible. Correspondingly, in FIG. 4 the compensating weights 2*a*, 2*b* are disposed on opposite sides of the elevator car 11 and on the same side of the guide rail line of the elevator car 11 as each other. In this case the reason has been e.g. some issue relating to layout, owing to which the space on the other side of the guide rail has been reserved for some other use than the use of compensating weights. In this solution also, however, it is possible to implement suspension that is as symmetrical as possible and that does not produce any additional stresses e.g. on the guide rails.

FIGS. 5 and 6 present a simplified and diagrammatic view of one second elevator arrangement according to the invention, wherein the hoisting machine 6 of the elevator is disposed in the bottom part of the elevator hoistway, or close to it. FIG. 5 presents the solution as viewed from the side, and FIG. 6 the same solution as viewed from the top of the hoisting machine 6. For the sake of clarity the compensating weights 2*a*, 2*b* are presented in FIG. 6 with dot-and-dash lines.

In the arrangement according to FIGS. 5 and 6 the traction means 7*b* and 7*b* are led to circulate from the compensating weights 2*b* and 2*b* to the elevator car in essentially the same manner as in the arrangement according to FIG. 2. The difference now, however, is that the hoisting machine 6 has been turned into such an attitude that the shaft of it is essentially vertical, in which case the plane of rotation of the traction sheave 5 is essentially on the horizontal plane. In this way a very shallow machine solution is achieved, which reduces the space requirement in the bottom part of the hoistway and enables driving of the elevator car to as far down as possible. The contact surface of the traction sheave 5 is, however, so wide that both the traction means 7*a*, 7*b* fit side-by-side onto the contact surface of the traction sheave without interfering with each other.

FIGS. 7 and 8 present a simplified and diagrammatic view of one more elevator arrangement according to the invention, wherein the hoisting machine 6 of the elevator is disposed in the bottom part of the elevator hoistway, or close to it. FIG. 7 presents the solution as viewed from the side, and FIG. 8 the same solution as viewed from the top of the hoisting machine 6. For the sake of clarity the compensating weights 2*a*, 2*b* are presented in FIG. 7*b* with dot-and-dash lines.

In the arrangement according to FIGS. 7*a* and 7*b* the traction means 7*a* and 7*b* are led to pass from the compensating weights 2*a* and 2*b* to fixing means 1*a*, 1*b* disposed in connection with the elevator car 11 directly via the traction sheaves 5, which are connected to a hoisting machine 6 via a shaft 6*a*. In the arrangement according to FIGS. 7 and 8 the traction sheaves 5 with their shafts 6*a* rotate in different directions to each other, but the arrangement can be implemented also such that both the traction sheaves 5 rotate in the same direction. From FIG. 8 it is seen that the hoisting machine 6 and its shaft 6*a* are at some certain angle with respect to the compensating weights 2*a*, 2*b* and their guide rail line. This angle can, however, vary, depending on the respective elevator layout solution. In this way a very shallow and simple machine solution is achieved without diverting pulleys in the bottom part of the hoistway, which solution reduces the space requirement in the bottom part of the hoistway and enables driving of the elevator car to as far down as possible.

FIG. 9 presents a front view of one more elevator arrangement according to the invention, comprising two hoisting machines 6 of the elevator, which, with the traction sheaves 5, are disposed in the bottom part of the elevator hoistway, or close to it. The first hoisting machine 6 is fitted between one or more compensating weights 2 and the elevator car 11 on one side of the elevator car 11, and the second hoisting machine 6 is fitted between one or more compensating weights 2 and the elevator car 11 on a second side of the elevator car 11. This solution enables the base of the elevator hoistway to be made level, particularly in its center part, and the lifting mechanics can be made simple.

According to the arrangements of FIGS. 1-9, the traction means 7, 7*a*, 7*b* can be either a plurality of parallel hoisting ropes, a chain or a belt, e.g. a toothed belt. What all the arrangements presented have in common is that the traction means 7, 7*a*, 7*b* are fixed at one of their ends, e.g. their ends on the elevator car 11 side, with fixing means 1, 1*a*, 1*b* providing a constant tensioning force such that a traction means 7, 7*a*, 7*b* always remains sufficiently taut on the rim of the traction sheave 5 and that when the support means 3 of the elevator car 11 stretch and loosen the fixing means 1, 1*a*, 1*b* remove the elongation produced via the traction means 7, 7*a*, 7*b*.

In the elevator arrangement according to the invention the supporting of the elevator car 11 is separated from the moving means of the elevator car and smart materials, such as toothed belts, in which traction is not based on friction but instead on shape-locking, preferably suited to the purpose are used as the moving means, i.e. as the traction means 7, 7*a*, 7*b*. Since the traction is not based on friction and elongations of the support means 3 can easily be compensated with the fixing means 1, 1*a*, 1*b* according to the invention that provide the traction means 7, 7*a*, 7*b* with a constant tensioning force, one or more compensating weights 2, 2*a*, 2*b* can be used instead of counterweights, which compensating weights are disposed in the elevator hoistway space-efficiently in relation to the cross-section of the elevator hoistway and their mass is optimized according to the use of the elevator such that the elevator arrangement is made to function in the best possible way in relation to energy efficiency in exactly the use for which it has been delivered. By proceeding in this manner the use of a new or modernized elevator is monitored initially after installation of the elevator and according to the monitoring results the balancing is adjusted e.g. within such limits that the aggregate mass of the compensating weights 2-2*b* is some suitable value between −10 . . . 60% of the rated load of the elevator, preferably e.g. some suitable value between 0 . . . 50% of the rated load of the elevator. The aforementioned space efficiency can be further improved with traction sheaves and diverting pulleys that are small in diameter and that can be disposed in a small space.

It should also be noted that the different solutions presented above can be inventive features together with one or more other features of the invention.

It is obvious to the person skilled in the art that the invention is not limited solely to the examples described above, but that it may be varied within the scope of the claims presented below. Thus, for example, the suspension solutions can be different to what is presented above.

It is further obvious to the person skilled in the art that the tensioning means can also be elsewhere than what is presented above in the drawings. For example, when connecting a traction means to the elevator car by the aid of a diverting pulley, i.e. when making so-called 2:1 roping for the traction means, the tensioning means can be fixed in the elevator hoistway to the base of the elevator hoistway or to near the base.

It is further obvious to the person skilled in the art that the location of the hoisting machine can be elsewhere than what is presented above in the drawings. The hoisting machine can be on the base of the elevator hoistway, or close to the base, but also on some side of the elevator hoistway and also in the top part of the elevator hoistway.

It is also obvious to the person skilled in the art that the number of compensating weights can also be greater than two or three. There can be e.g. four, six, eight, ten or even more compensating weights disposed in a different manner.

It is also obvious to the person skilled in the art that the fixing means providing the traction means with a constant tensioning force can just as well also be at the ends of the traction means on the compensating weight side.

It is also obvious to the skilled person that the spiral eccentric surface in connection with the roll of a fixing means can, instead of less than one spiral revolution, comprise one whole spiral revolution or a number of spiral revolutions. In this case the spiral eccentric surface can be smaller than, equal to or greater than 360°.

It is further obvious to the person skilled in the art that the aforementioned eccentric surface in connection with the roll can be disposed on the roll itself and a traction means or some traction means can pass over the aforementioned eccentric surface that enables compensation. In this case tensioning means tensioned by the aid of a spring force can be coiled around either a round wheel or also around an eccentric means.

The invention claimed is:

1. A tensioning arrangement for an elevator, which arrangement comprises:

at least an elevator car configured to move up and down in an elevator hoistway, at least one or more compensating weights supporting the elevator car via diverting pulleys, and a hoisting machine provided with at least one traction sheave, and at least two traction devices configured to transmit the rotational movement of the traction sheave into movement of the elevator car and of the compensating weights, wherein a first traction device of said at least two traction devices is fixed from at least one of its ends to a first fixing device and a second traction device of said at least two traction devices is fixed from at least one of its ends to a second fixing device, the first fixing device is disposed on a first side of the elevator car and the second fixing device is disposed on a second side of the elevator car opposite to the first side of the elevator car, wherein the first traction device extends downward from the first fixing device towards a first diverting pulley of said diverting pulleys, around a first side of said at least one traction sheave towards a second diverting pulley of said diverting pulleys and ascending to a first compensating weight of said at least one or more compensating weights, wherein the second traction device extends downwards from the second fixing device towards a third diverting pulley of said diverting pulleys, around a second side opposite to said first side of said at least one traction sheave towards a fourth diverting pulley of said diverting pulleys, and ascends to a second compensating weight of said at least one or more compensating weights, wherein each fixing device provides an essentially constant tensioning force to the traction device, wherein each fixing device comprises a frame having an interior portion enclosing a roll rotatable about an axle and enclosing an adjustment device fitted to said axle, the adjustment device is connected to said roll, and each fixing device further comprises a spring abutting against an outer portion of said frame, wherein one end of the respective traction device is fixed to a rim of the roll, and wherein the adjustment device has a surface that is spirally eccentric in relation to an axis of rotation of the roll.

2. The tensioning arrangement according to claim 1, wherein the respective traction device is fixed to the elevator car via a respective one of the first fixing device and a second fixing device.

3. The tensioning arrangement according to claim 2, wherein a tensioning device is fixed to the spirally eccentric surface of the adjustment device at a first end thereof.

4. The tensioning arrangement according to claim 1, wherein a tensioning device is fixed to the spirally eccentric surface of the adjustment device at a first end thereof.

5. The tensioning arrangement according to claim 4, wherein the eccentricity of the surface of the adjustment device is selected such that it has a spiral pitch that corresponds to a spring constant of the spring.

6. The tensioning arrangement according to claim 5, wherein when the traction device stretches or otherwise loosens, the spring is arranged to pull the tensioning device so as to rotate the roll and the adjustment device such that a distance of an outer rim of the adjustment device from the axle at a point of detachment of the tensioning device from the roll increases according to the eccentricity of the outer rim.

7. The tensioning arrangement according to claim 1, wherein a length of an outer rim of the adjustment device is smaller than 360°.

8. The tensioning arrangement according to claim 1, wherein a length of an outer rim of the adjustment device is greater than 360° including more than one spiral revolution.

9. The tensioning arrangement according to claim 1, wherein a tensioning device is fixed to the spirally eccentric surface of the adjustment device at a first end thereof.

* * * * *